US007083414B2

(12) United States Patent
Sansolo

(10) Patent No.: US 7,083,414 B2
(45) Date of Patent: Aug. 1, 2006

(54) EXPLOSION SIMULATION DEVICE

(76) Inventor: Arie Sansolo, 19 Harel Street, Afridar, Ashkelon 78649 (IL)

( * ) Notice: Subject to any disclaimer, the term of this patent is extended or adjusted under 35 U.S.C. 154(b) by 152 days.

(21) Appl. No.: 10/288,306

(22) Filed: Nov. 6, 2002

(65) Prior Publication Data

US 2003/0054322 A1 Mar. 20, 2003

Related U.S. Application Data

(63) Continuation-in-part of application No. PCT/IL01/00533, filed on Jun. 12, 2001.

(30) Foreign Application Priority Data

Jun. 16, 2000 (IL) ..... 136841

(51) Int. Cl.
*F24B 12/46* (2006.01)
*F24B 4/00* (2006.01)
*F41A 33/00* (2006.01)

(52) U.S. Cl. ..... 434/11; 102/355; 102/358; 102/367; 102/498

(58) Field of Classification Search ..... 434/11; 102/498, 355, 267, 268, 205, 486, 369, 395, 102/335, 487

See application file for complete search history.

(56) References Cited

U.S. PATENT DOCUMENTS

| | | | | |
|---|---|---|---|---|
| 1,994,081 | A * | 3/1935 | Willners | 102/261 |
| 2,548,946 | A * | 4/1951 | Clauser | 102/355 |
| 3,492,945 | A * | 2/1970 | Filippi | 102/498 |
| 3,508,518 | A * | 4/1970 | Flynn | 116/214 |
| 4,932,328 | A * | 6/1990 | Pinkney et al. | 102/482 |
| 5,481,979 | A * | 1/1996 | Walder | 102/498 |
| 5,654,523 | A * | 8/1997 | Brunn | 102/498 |
| 5,824,945 | A * | 10/1998 | Barlog et al. | 102/482 |
| 5,996,503 | A * | 12/1999 | Woodall et al. | 102/498 |
| 6,845,715 | B1 * | 1/2005 | Sansolo | 102/367 |

* cited by examiner

*Primary Examiner*—Dmitry Suhol
(74) *Attorney, Agent, or Firm*—Dekel Patent Ltd.; David Klein

(57) ABSTRACT

An explosion simulation device comprising an elongated body formed with a hollow chamber, the body being formed with end apertures at opposite ends thereof and a plurality of radially-directed side apertures along an axial length thereof, the end apertures and side apertures being in fluid communication with the hollow chamber, a pyrotechnic substance disposed in the hollow chamber, and a detonator disposed in the body for detonating the pyrotechnic substance, wherein the end apertures and side apertures are arranged with respect to one another such that forces of post-combustion gases, formed as a product of detonation of the pyrotechnic substance and which are vented through the end apertures and side apertures, are directed in directions that tend to cancel movement of the body.

9 Claims, 2 Drawing Sheets

EXPLOSION SIMULATION DEVICE

CROSS REFERENCE TO OTHER APPLICATIONS

This application is a continuation-in-part of PCT patent application PCT/IL01/00533 filed Jun. 12, 2001, and claims priority therefrom.

FIELD OF THE INVENTION

The present invention relates to an explosion simulation device, useful for creating the sound effect of an explosion, such as for military and police training simulations.

BACKGROUND OF THE INVENTION

Military and police personnel often encounter situations where the threat from an explosive device is present. Adequate training regarding how to respond to these situations is necessary in order to save the military or police personnel from injury or death. An extremely effective method of training is through the use of simulations. A simulation, as used here, is a recreation of the sound effects of a dangerous explosion for training purposes. Drawbacks of the known explosion simulation devices include the possibility of injury caused by dispersion of simulated explosion casing elements and the excessive amount of explosive material consumed. Accurate reproduction of a training environment is difficult to achieve because explosion simulation devices of the prior art may present risk to property and people.

In the prior art, explosive device simulators typically comprise a chemical pyrotechnic composition enclosed within a cardboard or paper enclosure. Ignition of this type of device results in debris flying from the paper case, with the possibility of injury.

SUMMARY OF THE INVENTION

The present invention relates to an explosion simulation device, useful for creating the sound effect of an explosion, which may reduce or eliminate movement of the device upon detonation of a pyrotechnic substance disposed therein, as is described in detail hereinbelow.

There is thus provided in accordance with an embodiment of the present invention an explosion simulation device comprising an elongated body formed with a hollow chamber, the body being formed with end apertures at opposite ends thereof and a plurality of radially-directed side apertures along an axial length thereof, the end apertures and side apertures being in fluid communication with the hollow chamber, a pyrotechnic substance disposed in the hollow chamber, and a detonator disposed in the body for detonating the pyrotechnic substance, wherein the end apertures and side apertures are arranged with respect to one another such that forces of post-combustion gases, formed as a product of detonation of the pyrotechnic substance and which are vented through the end apertures and side apertures, are directed in directions that tend to cancel movement of the body. The end apertures may be formed as through-holes in end caps attached to the body.

In accordance with an embodiment of the present invention the body is formed with at least one flat surface, which serves as a movement stabilizing surface. The flat surface may comprise a portion of a polygon.

Further in accordance with an embodiment of the present invention the detonator comprises an electric heating filament, which may comprise a material capable of achieving a temperature sufficient to ignite the pyrotechnic substance.

Still further in accordance with an embodiment of the present invention the side apertures are arranged in two or more radially-spaced parallel rows, wherein the rows may be spaced 15–90° apart, for example.

In accordance with an embodiment of the present invention at least one stabilizing leg is attached to the body.

Further in accordance with an embodiment of the present invention the at least one stabilizing leg is attached to an end of the body and comprises an extension that extends angularly away from the body. Additionally or alternatively, the at least one stabilizing leg is attached to an end of the body and comprises an extension that extends axially away from the body.

BRIEF DESCRIPTION OF THE DRAWINGS

The present invention is herein described, by way of example only, with reference to the accompanying figures, wherein.

DETAILED DESCRIPTION OF THE PREFERRED EMBODIMENT

It should be appreciated that the detailed description that follows is provided to describe certain preferred embodiments of the present invention. It in no way is intended to limit the scope of the invention, as set out in the claims.

Figure 1:
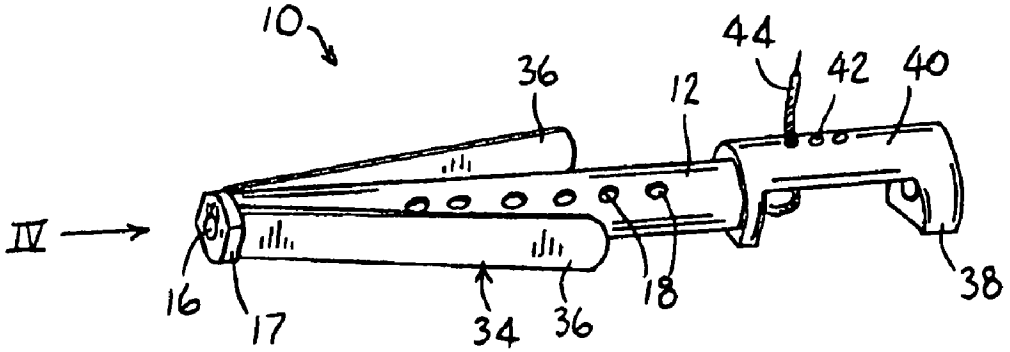
FIGS. 1 and 2 are simplified pictorial and exploded illustrations, respectively, of an explosion simulation device, constructed and operative in accordance with an embodiment of the present invention.
Figure 2:
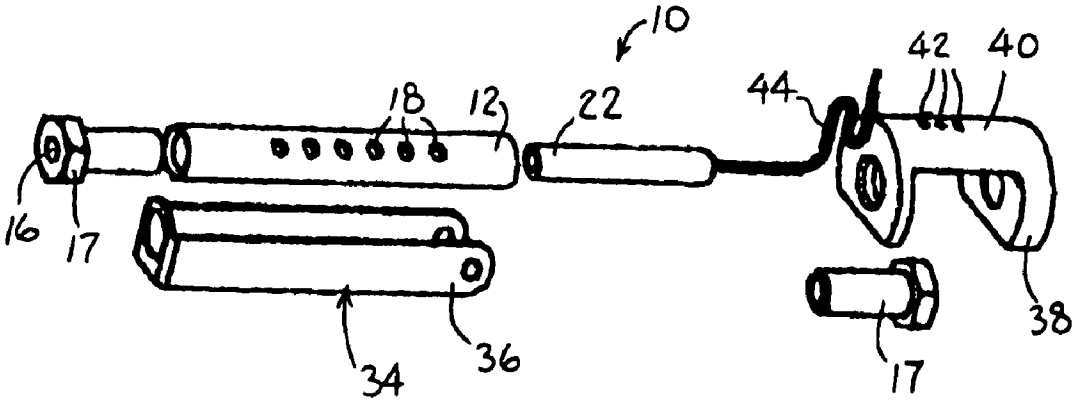
Figure 3:
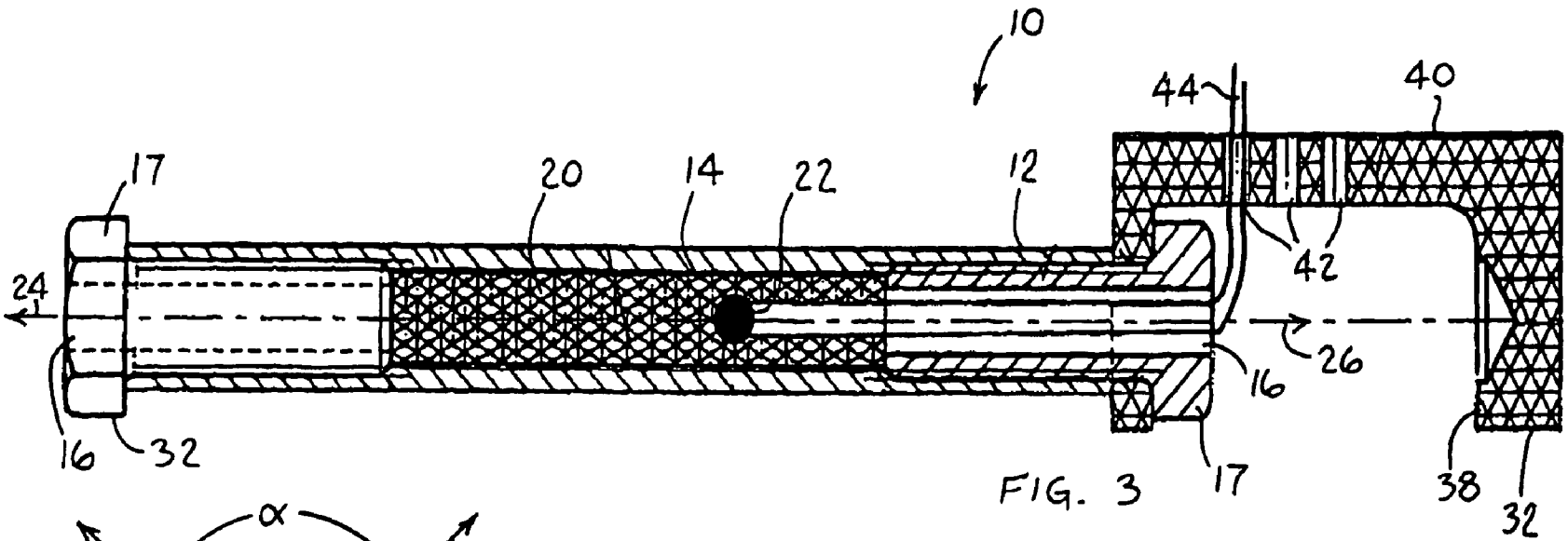
FIGS. 3 and 4 are simplified sectional and end-view illustrations, respectively, of the explosion simulation device of FIGS. 1 and 2, FIG. 4 being viewed along arrow IV in FIG. 1.
Figure 4:
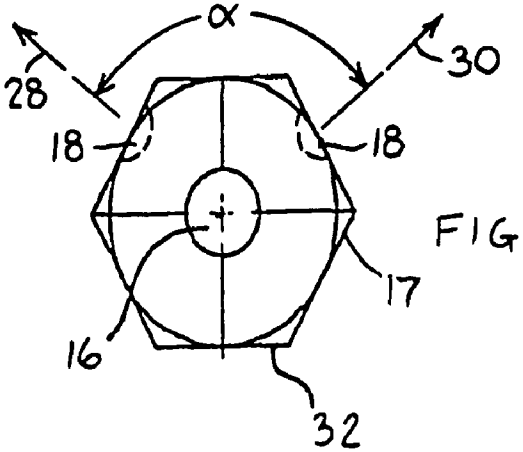

Reference is now made to FIGS. 1–4, which illustrate an explosion simulation device 10, constructed and operative in accordance with an embodiment of the present invention. comprising:

Explosion simulation device 10 may comprise an elongated body 12 formed with a hollow chamber 14. Body 12 may be formed with end apertures 16 at opposite ends thereof and a plurality of radially-directed side apertures 18 along an axial length thereof. End apertures 16 and side apertures 18 are in fluid communication with hollow chamber 14. End apertures 16 may be formed as through-holes in end caps 17 attached to body 12. A pyrotechnic substance 20, such as but not limited to, aluminum or magnesium powder, may be disposed in hollow chamber 14. Pyrotechnic substance 20 may be in the form of a powder and/or may be encased in a housing that may be inserted in hollow chamber 14.

Side apertures 18 may be arranged in two or more radially-spaced parallel rows. The rows may be spaced an angle $\alpha$ apart (for example, but not limited to, 15–90°).

A detonator 22 may be disposed in body 12 for detonating pyrotechnic substance 20. Detonator 22 may comprise, without limitation, an electric heating filament made of a material (e.g., a metal wire) capable of achieving a temperature sufficient to ignite pyrotechnic substance 20.

Detonator 22 may detonate pyrotechnic substance 20, thereby producing post-combustion gases. These post-combustion gases may be vented through end apertures 16

(shown by arrows 24 and 26) and/or side apertures 18 (shown by arrows 28 and 30).

In accordance with an embodiment of the present invention, end apertures 16 and/or side apertures 18 are arranged with respect to one another such that the forces of the post-combustion gases are directed in directions that tend to cancel movement of body 12. In other words, the forces in the direction of arrow 24 tend to cancel the forces in the opposite direction indicated by arrow 26, with the net result that body 12 may not appreciably move. Similarly, the forces in the directions of arrows 28 and 30 do not tend to move body 12.

In accordance with an embodiment of the present invention, further structure may be provided for stabilizing explosion simulation device 10. For example, body 12 may be formed with one or more flat surfaces 32, which serve as movement stabilizing surfaces when explosion simulation device 10 is laid upon the ground or other resting surface. The flat surface(s) 32 may comprise a portion of a polygon, such as but not limited to a hexagon or triangle.

In accordance with an embodiment of the present invention, explosion simulation device 10 may further comprise one or more stabilizing legs 34 attached to body 12. (Stabilizing legs 34 are omitted for the sake of simplicity in FIGS. 3 and 4.) For example, stabilizing leg 34 may be attached to an end of body 24 and comprise a pair of extension legs 36 that extend angularly away from body 12. Additionally or alternatively, as another example, a different stabilizing leg 38 may be attached to an opposite end of body 12 and comprises an extension 40 that extends axially away from body 12. The axial extension 40 may be formed with holes 42 for accommodating one or more wires 44 of detonator 22.

What is claimed is:

1. An explosion simulation device comprising:

an elongated body formed with a hollow chamber, said body being formed with end apertures at opposite ends thereof and a plurality of radially-directed side apertures along an axial length thereof, a bottom of said body being formed with at least one flat surface which serves as a movement stabilizing surface, said end apertures and side apertures being in fluid communication with said hollow chamber, wherein said side apertures are arranged in two or more radially-spaced parallel rows and no said side apertures face downwards when said movement stabilizing surface is placed on a resting surface;

a pyrotechnic substance disposed in said hollow chamber; and a detonator disposed in said body for detonating said pyrotechnic substance, wherein said end apertures and side apertures are arranged with respect to one another such that forces of post-combustion gases, formed as a product of detonation of said pyrotechnic substance and which are vented through said end apertures and side apertures, are directed in directions that tend to cancel movement of said body.

2. The device according to claim 1, wherein said detonator comprises an electric heating filament.

3. The device according to claim 2, wherein said electric heating filament comprises a material capable of achieving a temperature sufficient to ignite said pyrotechnic substance.

4. The device according to claim 1, wherein said rows are angularly spaced 15–90° apart.

5. The device according to claim 1, wherein said at least one flat surface comprises a portion of a polygon.

6. The device according to claim 1, further comprising at least one stabilizing leg attached to said body.

7. The device according to claim 6, wherein said at least one stabilizing leg is attached to an end of said body and comprises an extension that extends angularly away from said body.

8. The device according to claim 6, wherein said at least one stabilizing leg is attached to an end of said body and comprises an extension that extends axially away from said body.

9. The device according to claim 1, wherein said end apertures are formed as through-holes in end caps attached to said body.

* * * * *